United States Patent [19]

Fuerst

[11] 4,385,582

[45] May 31, 1983

[54] INFLATABLE DEVICE TO CLOSE A HULL BREACH

[76] Inventor: Erwin J. Fuerst, 1183 N. River Rd., St. Clair, Mich. 48979

[21] Appl. No.: 252,394

[22] Filed: Apr. 9, 1981

[51] Int. Cl.[3] ..... B63B 43/16

[52] U.S. Cl. ..... 114/227; 114/228; 114/229; 405/11; 135/20 B; 206/522

[58] Field of Search ..... 114/227, 228, 229, 44, 114/50, 54; 405/11-13; 220/239, 232; 206/522; 135/20 B

[56] References Cited

U.S. PATENT DOCUMENTS

| | | | |
|---|---|---|---|
| 1,411,560 | 4/1922 | Beaty | 135/20 B |
| 1,676,395 | 7/1928 | Korner | 114/227 |
| 2,220,085 | 11/1940 | Dirschel | 114/227 |
| 3,361,145 | 1/1968 | Jones | 135/20 B |
| 3,841,256 | 10/1974 | Etchelcou | 114/227 |
| 4,044,867 | 8/1977 | Fisher | 206/522 |

FOREIGN PATENT DOCUMENTS

| | | | |
|---|---|---|---|
| 600026 | 3/1976 | U.S.S.R. | 114/227 |

*Primary Examiner*—Trygve M. Blix
*Assistant Examiner*—D. W. Keen
*Attorney, Agent, or Firm*—Barnes, Kisselle, Raisch, Choate, Whittemore & Hulbert

[57] ABSTRACT

A portable device for closing a breach in a boat hull from the inside or the outside which includes an inflatable shallow dome sortable in a cylindrical form and automatically inflatable by the use of a self-contained cartridge to cause expansion into a non-buoyant shallow dome which can seal against a hull breach and enable a damaged boat to reach port.

5 Claims, 7 Drawing Figures

INFLATABLE DEVICE TO CLOSE A HULL BREACH

FIELD OF INVENTION

Portable and expandable emergency devices for temporary closing of accidental breaches in boat hulls.

BACKGROUND OF INVENTION

Occasionally that portion of the hull of a boat which is under water will be breached by a submerged object and the boat may founder if no means is found to close the breach to permit the boat to reach a repair dock. Devices in the form of plugs which have various retention means have been known for closing of the these holes in hulls as illustrated, for example, in a U.S. patent to Korner, U.S. Pat. No. 1,676,395 (7-10-28) utilizing a steel dome mechanically retained, a U.S. patent to Etchelecou, U.S. Pat. No. 3,841,256 (10-15-74) utilizing an inflatable bag, and a Russian Pat. No. 600,026 (4-18-78) utilizing an expandable cone. However, it is frequently impossible to have access to a hull breach from the inside without destroying the interior furnishings. Also devices which are buoyant will not stay in place unless mechanically restrained.

The present invention is intended to be an improved device which can be conveniently stored and readily used to block hull holes either from the inside of the boat, when accessible from the inside, or from the outside when inaccessible from the inside. The device for plugging the breach is flexible to adapt to varying contours and has inflatable ribs which shape the device to an expanded state for use. The device can be stored in a relatively small package and carries a gas pressure cartridge which is used to expand the device for use.

Objects and features of the invention will be apparent in the following description and claims in which the invention is described and detail on the manner of making and using the invention are provided for persons skilled in the art.

BRIEF DESCRIPTION OF THE DRAWINGS

Drawings accompany the disclosure and the various views thereof may be briefly described as.

DETAILED DESCRIPTION OF THE INVENTION AND THE MANNER OF MAKING AND USING IT

The invention consists of a circular shield of flexible material such as rubber or neoprene or an equivalent in plastic. This shield has hollow radial and circumferential ribs which can be inflated to provide a skeletal shape to the device, the flexible material extending as webs between the radial ribs and extending outwardly to form a flexible sealing rim outside the circumferential rib. In extended position, the device is domed to provide a convex outer surface and a concave inner surface. The device is designed such that it is not inherently buoyant when expanded to the functional state. The differential pressure serves to retain the device in the same manner that a suction cup is retained.

Figure 1:
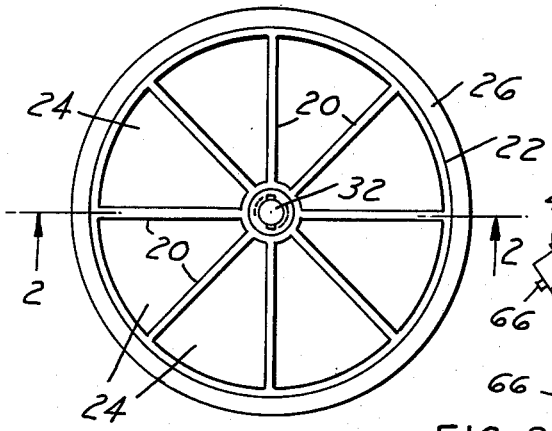
FIG. 1, an elevational view of the device when in expanded state for use.
Figure 3:
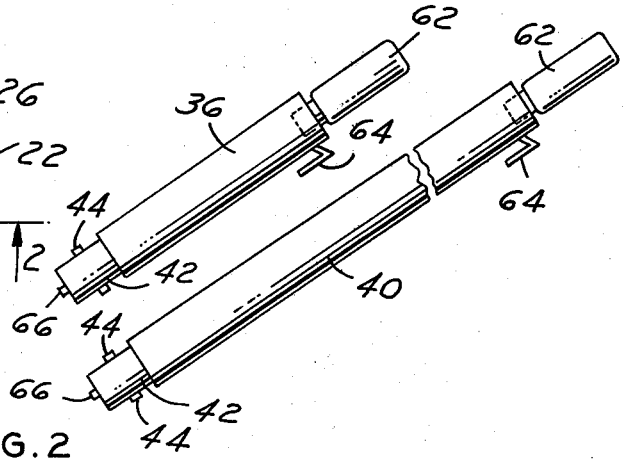
FIG. 3, a view of alternate long and short handles for use with the device.
Figure 2:
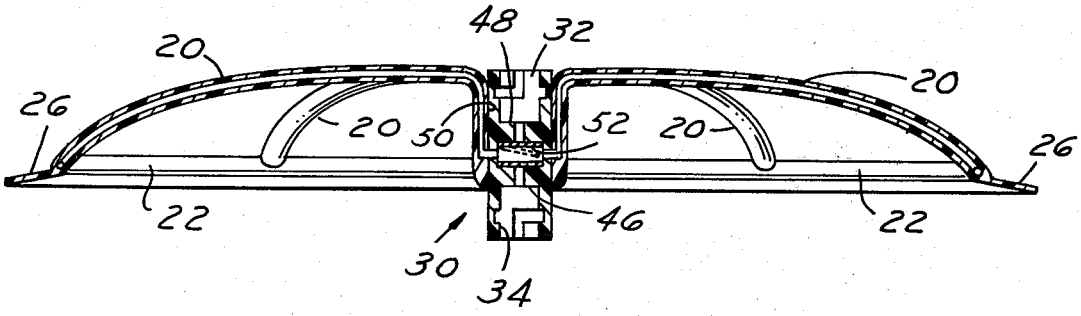
FIG. 2, a sectional view on line 2—2 of FIG. 1.

With reference to the drawings, in FIG. 1, a view of the shield in expanded position is shown, taken from the convex side and FIG. 2 shows a sectional view. The shield has eight hollow radial ribs 20, each connected mechanically and pneumatically to a circumferential passage 22. When subject to internal pressure, these ribs assume the shape shown in FIGS. 1 and 2. Between the ribs 20 is web material 24 which is water proof and flexible. Outside the passage 22 forming a flexible perimeter is a flexible circumferential rim 26 which will conform to the side of a boat around a breach in the hull. The material from which the passages 20 and 22 are formed is preferably thicker in wall dimension than the webs and periphery to provide a stability to the inflated structure.

The core of the device consists of a plastic or rubber cylinder 30 which has openings 32 and 34 respectively at each end to receive handles 36 and 40 in the respective ends. Each handle has a reduced end 42 with lugs 44 to interengage bayonet slots in the openings 32 and 34. Apertured diaphragms 46 and 48 are spaced from each other in the core cylinder and radial openings in the wall of the core between these diaphragms are provided to supply gas under pressure to ribs 20.

The shield has a central recess 50 which fits tightly around cylinder 30 and is sealed in position. The radial openings between the diaphragms 46 and 48 each communicate with a rib 20. Flap valves 52 are formed of flexible material and will serve to close the apertures in the diaphragm when subject to pressure from the inside.

Figure 5:
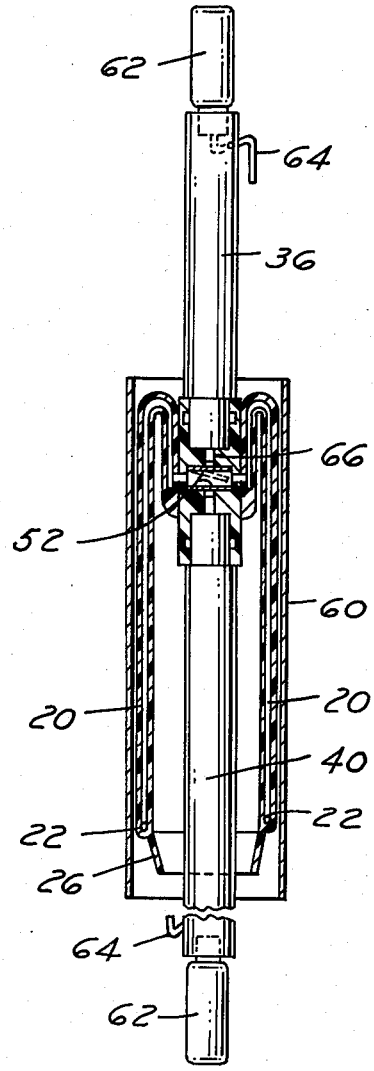
FIG. 5, a sectional view of the device in storage state.
Figure 7:
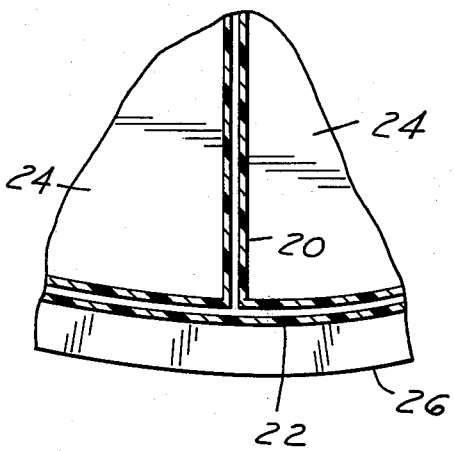
FIG. 7, a view of the hollow rib construction.

In FIG. 5, the device is shown in collapsed form retained in a protective cylinder 60. The handles 36 and 40 are in position. Each handle has an outer end which mounts a $CO_2$ cartridge 62 and standard triggers 64 are used to puncture the retaining diaphragm in the cartridge. Each cartridge feeds to a tube 66 which projects from the end of the handle and in position shown in FIG. 5, holds the flap valves 52 open.

When one handle is removed, the flap valve on that side will close. Upon triggering the cartridge in the other handle, $CO_2$ gas under pressure will flow into the space between the diaphragm and into ribs 20 and 22 causing the shield to distend in to its functional shape. Upon removal of the actuated handle, the other flap valve will close to retain the gas in the expanded shield. Other types of one way valves may be used, if desired, such as spring pressed check valves which will close upon removal of projection 66.

Figure 4:
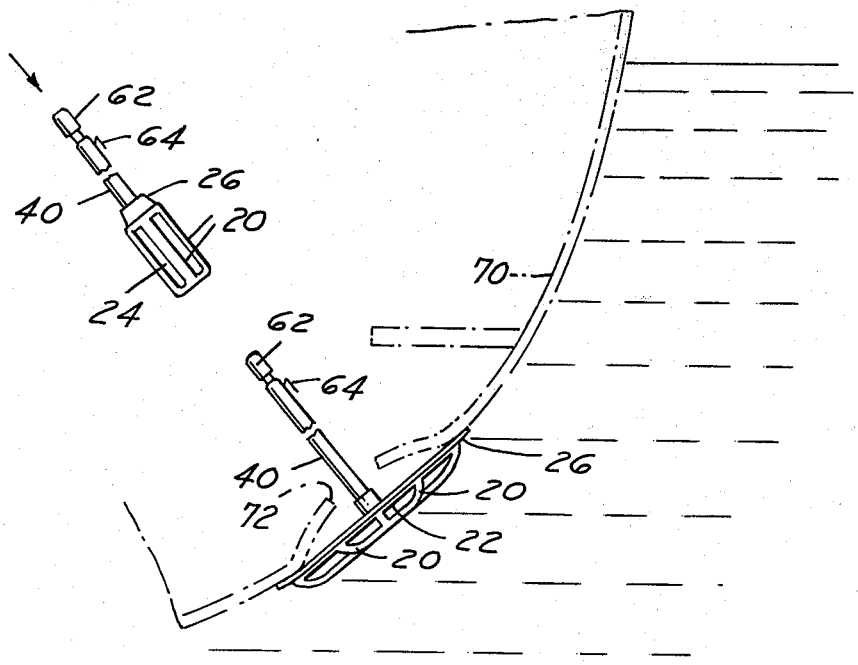
FIG. 4, a view of the device installed from the inside over a hull breach.

In FIG. 4, the device is shown being used from the interior of the hull with the long handle 40. This handle should in length be at least twice the diameter of the inflated unit so that the uninflated unit may be projected through thel hull and inflated some distance out in undisturbed water. The long handle also permits the use of the container 60 as a shield when projecting the unit through the hole. This protects the unit from damage from jagged edges on the hull prior to inflation. The gas cartridge is then triggered and the device expands as shown and is brought back against the outside of the hull around the breach. The handle 40 can now be removed and the device will be held against the hull by the water pressure outside the hull. However, if desired, the handle may be left in place and secured on the inside of the hull.

Figure 6:
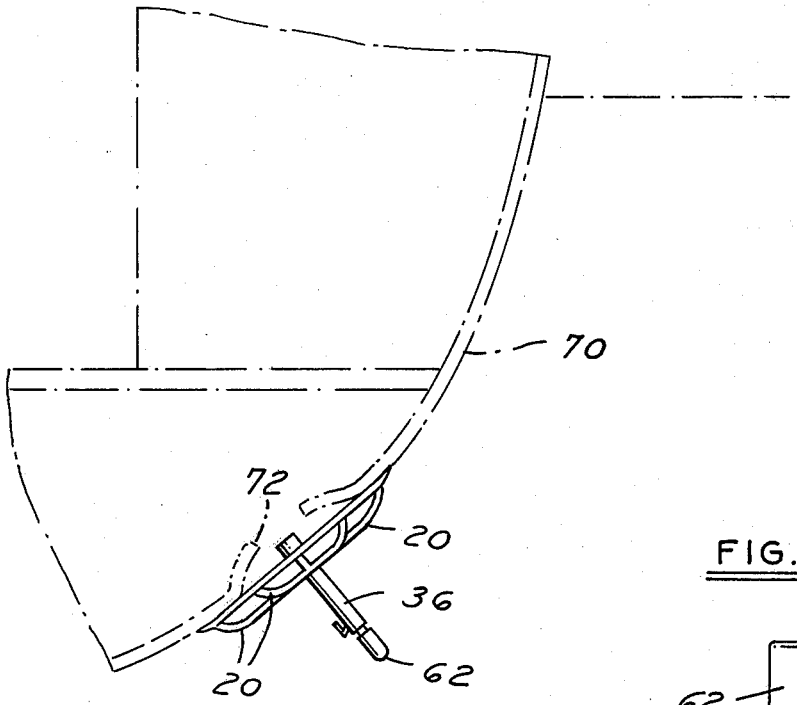
FIG. 6, a view of the device installed from the outside.

In FIG. 6, the device is shown used from the outside of the hull with the short handle 36. Inflation of the ribs is obtained in the same way and the handle can be removed after the shield is put in place. When the breach is plugged from the outside, the skipper has the option of exposing the damaged hull from the inside in an unhurried and non-destructive manner and he then may attach the handle to the plug unit from the inside and secure it. With the emergency situation under control, definitive repairs can be considered either while still at sea or after reaching port.

When the damaged boat reaches drydock or is elevated to expose the breach, the shield can be removed and deflated by inserting one of the handles or any other probe. The short projections 66 on the end of the handle will open a flat valve and allow the inflating gas to escape. A new $CO_2$ cartridge can then be installed in place of the used one and the device folded into the storage cylinder for future use.

The use of compressed gas cartridge insures a rapid readiness of the shield into functional shape.

It is significant in the construction of the described unit that it be non-buoyant when inflated. This renders the unit easy to handle in the submerged state. This contributes to the stability of the device when positioned over the breach since the pressure of the head of water exerted against the outer wet side surface is significantly greater than the reactive atmospheric pressure on the inner dry side of the unit.

What I claim is:

1. An apparatus for closing accidental breaches in the bottom and side walls of water going vessels which comprises:

(a) a flexible disc-like collapsible shield having a plurality of hollow flexible radial rib passages pneumatically connected to a hollow flexible peripheral passage, (b) impervious web-like connections between said passages, (c) means associated with said passages to conduct and retain fluid under pressure to said passages to cause said shield to assume a distended functional shape, said means comprising a core having opposed recesses exposed on each side of said shield selectively to receive one end of a positioning handle, (d) a positioning handle having one end to insert into a core recess, and (e) means on said handle to discharge compressed gas into said core from either side of said shield.

2. An apparatus as defined in claim 1, in which said core has a central chamber between said recesses, valves to close said recesses from said chamber, said valves being closed in response to pressure in said chamber.

3. An apparatus as defined in claim 1 in which said shield has a continuous flexible perimeter extending radially beyond said peripheral passage and inclined in a direction away from said concave side of said shield.

4. An apparatus for closing accidental breaches in the bottom and side walls of water going vessels which comprises:

(a) a flexible and collapsible, dish shaped, shield having a convex side and a concave side and a plurality of hollow flexible passage including a peripheral passage adjacent the edge of the shield and radial rib passages pneumatically associated with said peripheral passage, (b) water impervious, flexible web-like sheets between said peripheral and said radial passages, (c) means associated with said passages to conduct and retain fluid under pressure to said passages to cause said passages to distend and said shield to alter from a collapsed position to a distended dish-shaped configuration, and (d) said means comprising a central core including an aperture to which said radial passages are pneumatically open, and said means further comprising a cylindrical member secured in said aperture having opposed end recesses and a chamber between said recesses open to said radial passages, a handle having an end to be selectively received in said recesses carrying means to inflate said passages and distend said shield, and valves to close said recesses from said chamber in response to pressure in said recesses and said chamber.

5. An apparatus for closing accidental breaches in the bottom and side walls of water going vessels which comprises:

(a) a flexible and collapsible, dish shaped, shield having a convex side and a concave side and a plurality of hollow flexible passages including a peripheral passage adjacent the edge of the shield and radial rib passages pneumatically associated with said peripheral passage, (b) water impervious, flexible web-like sheets between said peripheral and said radial passages, (c) means associated with said passages to conduct and retain fluid under pressure to said passages to cause said passages to distend and said shield to alter from a collapsed position to a distended dish-shaped configuration, (d) said means comprising a central passageway in said flexible shield pneumatically associated with said passages and open to the convex side and the concave side of said shield when inflated, and (e) means insertable into said central passageway from either side of said shield to direct a compressed gas into said passageway and said passages to cause inflation of said flexible shield.

* * * * *